US005688111A

United States Patent [19]

Takai

[11] Patent Number: 5,688,111

[45] Date of Patent: Nov. 18, 1997

[54] VALVED SUCTION MECHANISM OF A REFRIGERANT COMPRESSOR

[75] Inventor: Kazuhiko Takai, Gunma, Japan

[73] Assignee: Sanden Corporation, Isesaki, Japan

[21] Appl. No.: 523,921

[22] Filed: Sep. 6, 1995

[30] Foreign Application Priority Data

Sep. 6, 1994 [JP] Japan ..... 6-238568

[51] Int. Cl.[6] ..... F04B 39/08; F04B 49/22

[52] U.S. Cl. ..... 417/298; 417/270

[58] Field of Search ..... 417/298, 295, 417/270

[56] References Cited

U.S. PATENT DOCUMENTS

| | | | |
|---|---|---|---|
| 2,544,821 | 3/1951 | Bartholomew | 417/298 X |
| 2,585,168 | 2/1952 | Platts | 417/298 X |
| 3,043,496 | 7/1962 | Glass et al. | 417/298 X |
| 3,073,510 | 1/1963 | Hackbart et al. | 417/298 |
| 4,330,999 | 5/1982 | Nakayama . | |
| 4,519,752 | 5/1985 | Valentin | 417/270 |
| 4,588,359 | 5/1986 | Hikade | 417/298 |
| 4,730,987 | 3/1988 | Kawai et al. | 417/298 X |
| 4,867,650 | 9/1989 | Ikeda et al. . | |
| 5,332,365 | 7/1994 | Taguchi | 417/270 X |

FOREIGN PATENT DOCUMENTS

| | | | |
|---|---|---|---|
| 2264198 | 10/1975 | France . | |
| 2357578 | 5/1975 | Germany . | |
| 3345267 | 6/1984 | Germany . | |
| 56-174870 | 5/1983 | Japan | 417/270 |
| 62-82282 | 4/1987 | Japan | 417/270 |

*Primary Examiner*—Richard E. Gluck
*Attorney, Agent, or Firm*—Baker & Botts, L.L.P.

[57] ABSTRACT

A compressor has a housing divided by a valve plate into a first chamber and a second chamber. The second chamber has a suction chamber and a discharge chamber. The valve plate includes discharge conduits communicating the first chamber with the discharge chamber and suction conduits communicating the first chamber with the suction chamber. A suction valve member bends to open and close the suction conduits in response to changes in discharge chamber pressure and the resulting pressure difference between the first chamber and the suction chamber. A suction valve control mechanism includes a regulator for regulating opening and closing of the suction valve between a maximum opening position and a minimum opening position in response to changes in discharge chamber pressure.

19 Claims, 7 Drawing Sheets

FIG. 8
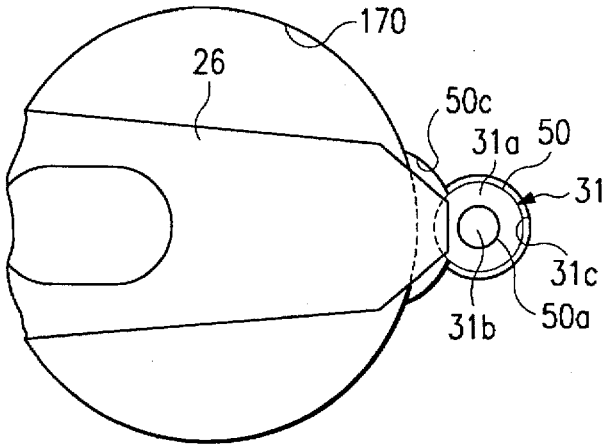
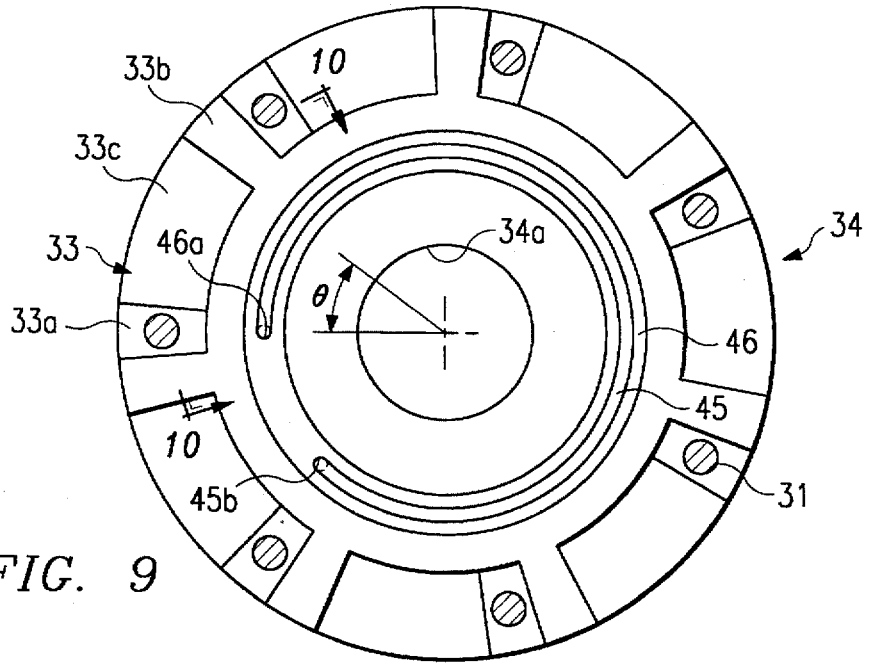
FIG. 9
FIG. 10
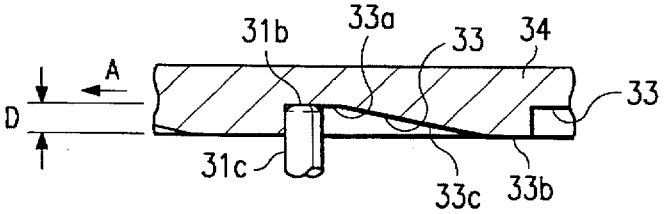

VALVED SUCTION MECHANISM OF A REFRIGERANT COMPRESSOR

BACKGROUND OF THE INVENTION

1. Field of the Invention

The present invention relates to a refrigerant compressor and, more particularly, to a valved suction mechanism of a refrigerant compressor capable of being used in an automotive air conditioning system.

2. Description of the Related Art

Valved suction mechanisms of refrigerant compressors are generally known in the related art. For example, FIG. 1 depicts a valved suction mechanism in a refrigerant compressor as described in U.S. Pat. No. 4,867,650 issued to Ikeda et al. As described therein, a compressor 10 comprises a cylindrical housing assembly 120 including a cylinder block 121, a front end plate 123 at one end of cylinder block 121, and a rear end plate 124 at the other end of cylinder block 121. A crank chamber 122 is formed between cylinder block 121 and front end plate 123. Front end plate 123 is mounted on the front end of cylinder block 121 (toward the left side of FIG. 1) by a plurality of bolts (not shown). Rear end plate 124 is mounted on cylinder block 121 at its rear end (towards the right in FIG. 1) by a plurality of bolts 102. A valve plate 125 is located between rear end plate 124 and cylinder block 121. Valve plate 125 divides housing assembly 120 into a first chamber and a second chamber. The first chamber includes that portion of the interior of housing assembly 120 located on the same side of valve plate 125 as crank chamber 122. The second chamber includes that portion of the interior of housing assembly 120 located on the side valve plate 125 opposite the first chamber. An opening 231 is centrally formed in front end plate 123 for supporting a drive shaft 126 by a bearing 130, which is disposed in opening 231. An inner end portion of drive shaft 126 is rotatably supported by a bearing 131 disposed within a center bore 210 formed in cylinder block 121. Bore 210 extends to a rearward end surface of cylinder block 121 wherein there is disposed a valve control mechanism 119.

A cam rotor 140 is attached to drive shaft 126 by a pin member 261 and rotates together with shaft 126. A thrust needle bearing 132 is disposed between an inner end surface of front end plate 123 and an adjacent axial end surface of cam rotor 140. Cam rotor 140 has an arm 141 with a pin member 142 extending therefrom. A slant plate 150 is adjacent cam rotor 140 and has an opening 153 through which passes drive shaft 126. Slant plate 150 includes an arm 151 having a slot 152. Cam rotor 140 and slant plate 150 are coupled by pin member 142, which extends through slot 152 to create a hinged joint. Pin member 142 is slidable within slot 152 to allow adjustment of an angular position of slant plate 150 with respect to a longitudinal axis of drive shaft 126.

A wobble plate 160 is nutatably mounted on slant plate 150 through bearings 161 and 162. A fork-shaped slider 163 is attached to an outer peripheral end of wobble plate 160 and is slidably mounted on a sliding rail 164, which is held between front end plate 123 and cylinder block 121. Fork-shaped slider 163 prevents rotation of wobble plate 160. Wobble plate 160 nutates along rail 164 as cam rotor 140 rotates with drive shaft 126. Cylinder block 121 includes a plurality of peripherally-located cylinders 170 in which a plurality of corresponding pistons 171 reciprocate. Each piston 171 is connected to wobble plate 160 by a connecting rod 172.

Rear end plate 124 has a peripherally-located annular suction chamber 241 and a centrally-located discharge chamber 251. Valve plate 125 has a plurality of valved suction conduits 242 linking suction chamber 241 with the respective cylinders 170. Valve plate 125 also has a plurality of valved discharge conduits 252 linking discharge chamber 251 with the respective cylinders 170.

Suction chamber 241 is connected to an evaporator (not shown) of a cooling circuit (not shown) by way of an inlet port 241*a*. Discharge chamber 251 is provided with outlet port 251*a*, which is connected to a condenser (not shown) of the cooling circuit (not shown). Gaskets 127 and 128 are respectively located between cylinder block 121 and an inner surface of valve plate 125, and an outer surface of valve plate 125 and rear end plate 124, to seal the mating surfaces of cylinder block 121, valve plate 125 and rear end plate 124.

A disk-shaped adjusting screw member 133 is disposed in a central region of bore 210 between bearing 131 and valve control mechanism 119. Disk-shaped adjusting screw member 133 is screwed into bore 210 to be in contact with the inner end surface of drive shaft 126 through a washer 34, and adjusts an axial position of drive shaft 126 by tightening or loosing thereof.

Connecting rod 172 has first and second ball portions 173*a* and 173*b* respectively formed at the front and rear ends thereof. Piston 171 is connected to second ball portion 173*b*. A discharge valve assembly includes a discharge reed valve 181 and a valve retainer 180 which are secured together to valve plate 125 by a fixing bolt 100. Gasket 127 includes suction valve 191, formed therein, which opens and closes the suction conduits 242. A groove 190 is formed on a periphery of each cylinder 170 at the rearward and radially outer-most location thereof. Groove 190 restricts the opening motion of suction valve 191 by engaging a tip portion of suction valve 191.

In this arrangement, referring to FIG. 2, if groove 190 is designed to have a relatively large axial dimension, an aperture between suction conduit 242 and suction valve 191 becomes relatively large because suction valve 191 opens until contacting with a forward end surface-of groove 190. This causes a decrease in pressure loss through suction conduit 242 and results in an increase in volumetric efficiency. Thus, the compressor can obtain a high discharge ability. However, in a low load situation, as the volume of a refrigerant gas within compressor 10 decreases, the tip portion of suction valve 191 does not contact with groove 190 even if suction valve 191 opens a maximum amount. In this situation, suction valve 191 vibrates without contacting groove 190 during reciprocation of pistons 170. Thus, suction valve 191 produces an undesirable ripple noise. To reduce this unpleasant noise at low load situations, the aperture between suction valve 191 and suction hole 242 should be designed to be relatively shallow. Accordingly, a depth D (FIG. 2) of groove 190 should be designed be small. Moreover, this has the effect of reducing starting torque shock of the compressor when the compressor starts by operation of clutch 300. Starting torque shock occurs in some prior art compressors at the time of starting of the compressor. When a compressor has a suction valve assembly with a high opening level during starting, a relatively large amount of refrigerant gas is introduced into the cylinders, thus requiting a great deal of power to compress the gas.

A disadvantage of this design is that if the depth of groove 190 is designed to be small, in order to reduce ripple noise and starting torque shock of the compressor, the discharge ability of the compressor is reduced since the pressure loss of the refrigerant gas increases. Consequently, volumetric efficiency decreases. In this situation, it becomes necessary to increase the compressor size in order to increase volumetric efficiency. Therefore, it is difficult to simultaneously resolve each of the above-mentioned problems.

SUMMARY OF THE INVENTION

It is an object of the present invention, therefore, to provide a refrigerant compressor, which may be used in an automotive air conditioning system, wherein a refrigerating capacity can increase without increasing the compressor size.

It is another object of the present invention to provide a refrigerant compressor wherein a starting torque shock can be reduced.

It is yet another object of the present invention to provide a refrigerant compressor which can effectively reduce vibrational noise caused by a suction valve assembly.

It is still another object of the present invention to reduce starting shock torque and suction valve vibrational noise while maintaining high volumetric efficiency of the compressor.

To achieve these and other objects of the present invention, a compressor housing is divided by a valve plate into a first chamber and a second chamber. The second chamber includes a discharge chamber and a suction chamber. The first chamber is linked to the discharge chamber by a plurality of discharge conduits. The first chamber is linked to the suction chamber by a plurality of suction conduits. A plurality of discharge valve members are responsive to a difference in pressure between the discharge chamber and the first chamber to bend to open and close the end opening of corresponding discharge conduits. A plurality of suction valve members are responsive to a difference in pressure between the suction chamber and the first chamber to bend to open and close the end opening of corresponding suction conduits. A suction valve control mechanism has a regulator for regulating the opening of the suction conduits in response to a change in the discharge chamber pressure.

Further objects, features and other advantages of the present invention will be understood from the detailed description of the preferred embodiments with reference to the appropriate figures.

BRIEF DESCRIPTION OF THE DRAWINGS

FIG. 8 is a partial axial view of a suction valve assembly in accordance with a first embodiment of the present invention.

FIG. 9 is a partial axial view of a suction valve assembly in accordance with a first embodiment of the present invention.

FIG. 10 is an enlarged partial sectional view of a suction valve assembly in accordance with a first embodiment of the present invention and taken along line 10—10 of FIG. 9.

DETAILED DESCRIPTION OF THE PREFERRED EMBODIMENTS

Figure 3:
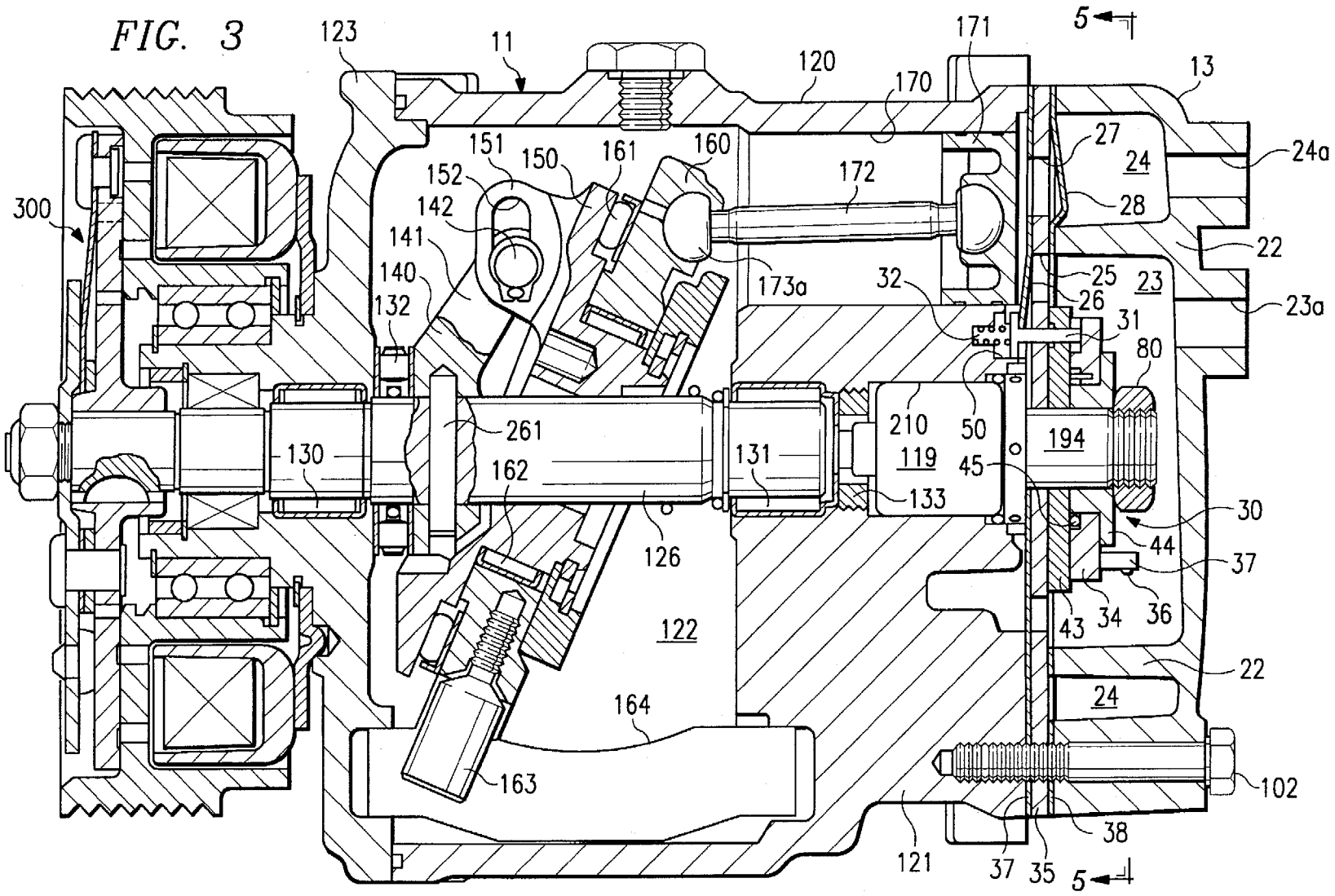
FIG. 3 is a longitudinal sectional view of a slant plate compressor in accordance with a first embodiment of the present invention.

FIG. 3 illustrates a fluid displacement apparatus in accordance with the present invention and, in particular, a slant plate compressor according to one embodiment of the present invention. Compressor 11 includes a plurality of suction valve members 26 and a plurality of discharge valve members 28. Certain features of compressor 11 are similar to those described above in connection with the compressor depicted in FIG. 1. Therefore, a detailed description of the similar compressor features is omitted.

Figure 1:
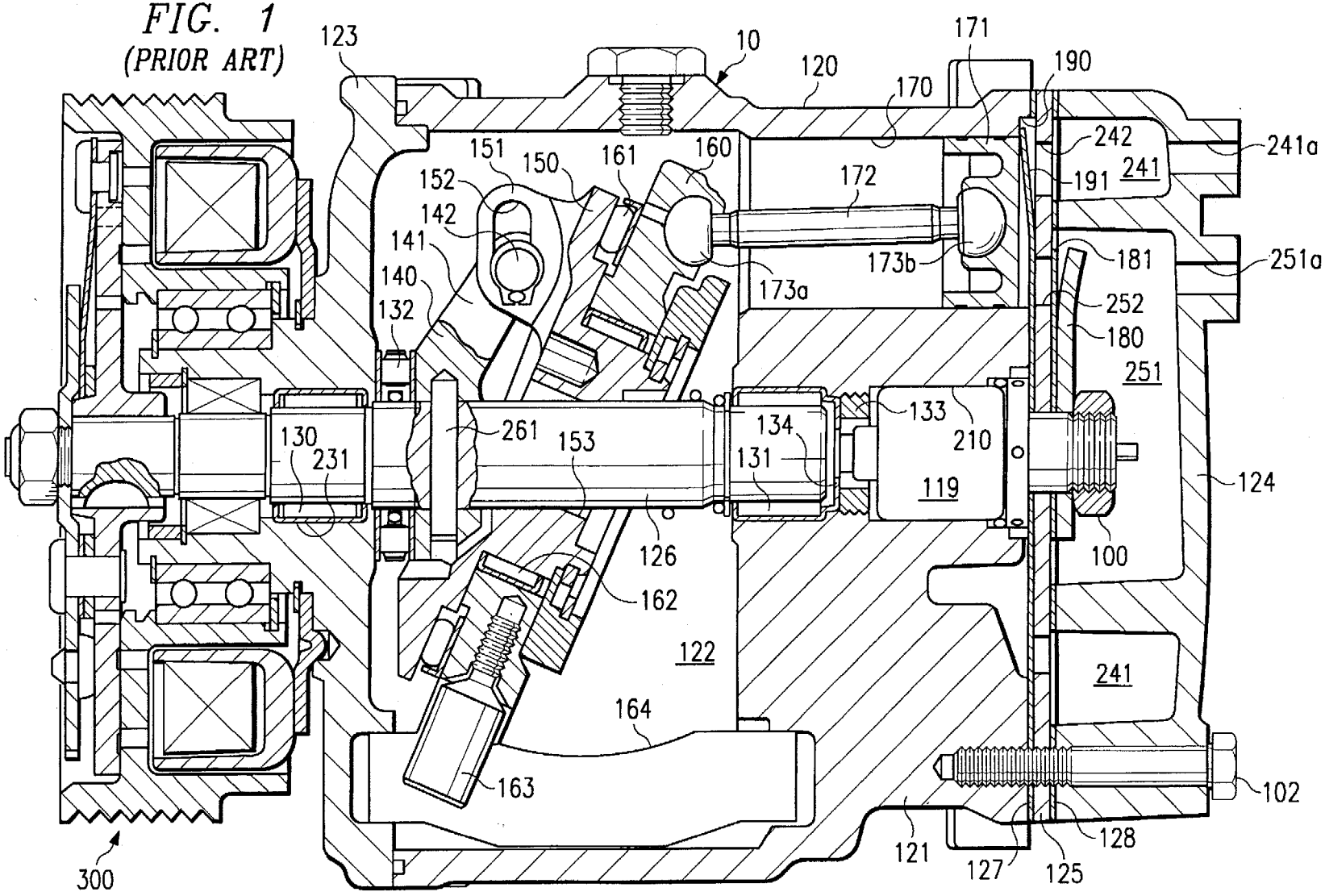
FIG. 1 (PRIOR ART)
FIG. 1 is a longitudinal sectional view of a slant plate compressor in accordance with the prior art.
Figure 2:
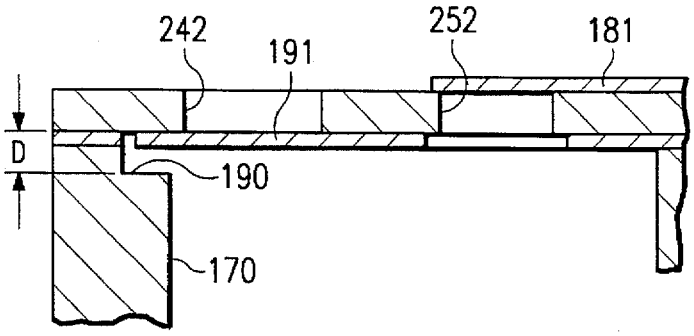
FIG. 2 (PRIOR ART)
FIG. 2 is an enlarged sectional view of a suction valve assembly in accordance with the prior art.
Figure 4:
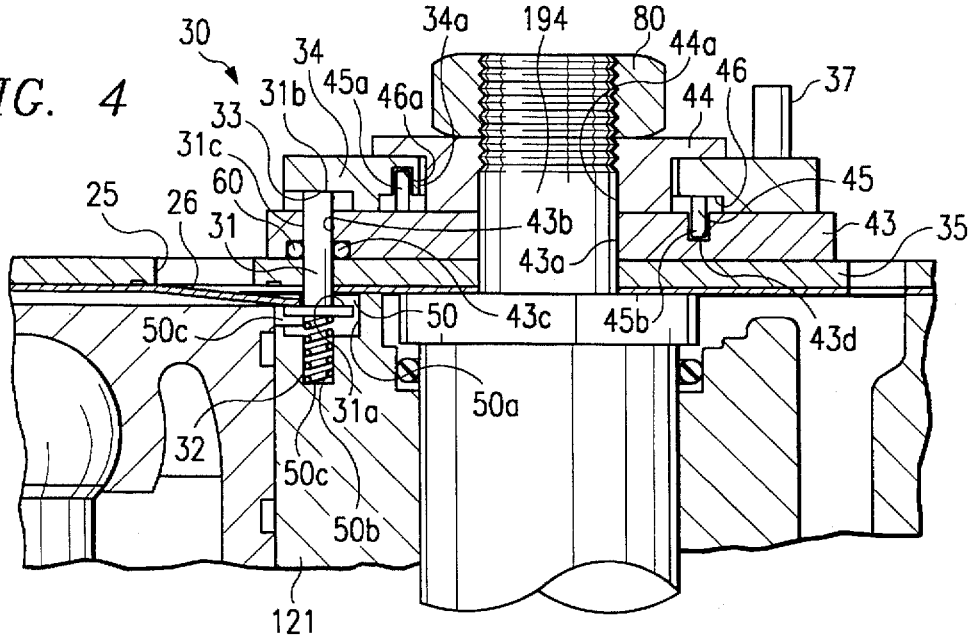
FIG. 4 is an enlarged sectional view of a suction valve assembly in accordance with a first embodiment of the present invention.
Figure 5:
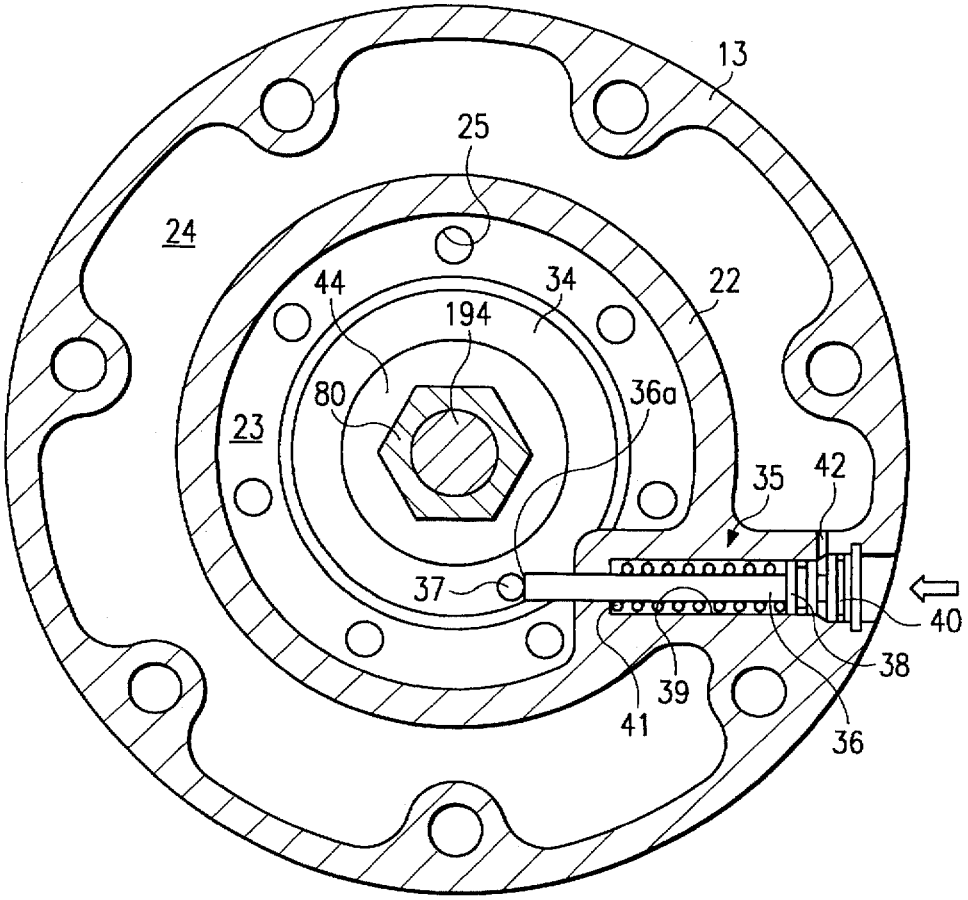
FIG. 5 is a cross-sectional view of the compressor of FIG. 3 taken along line 5—5 of showing the suction valve assembly of FIG. 3.

One of the differences between compressor 11 and the compressor shown in FIG. 1 is that compressor 11 has a peripherally-located annular discharge chamber 24 and a centrally-located suction chamber 23. Referring further to FIGS. 4 and 5, a suction valve mechanism 30 comprises a base plate 43 in contact with a first side surface of a valve plate 35, a supporting plate 44, and a control plate 34 slidably sandwiched between base plate 43 and supporting plate 44. Base plate 43, control plate 34 and supporting plate 44 have openings **43*a*, 34*a* and 44*a* respectively formed at a central portion thereof, and are secured with together by a coupling device, such as nut 80, so that axial movement of base plate 43, control plate 34 and supporting plate 44 is restricted. Preferably, threaded cylindrical member 194 inserts into openings 43*a*, 34*a* and 44*a*. Further, base plate 43 has a plurality of holes 43*b*, which preferably correspond to a number of cylinders 170 of compressor 11, and which are preferably formed at equal intervals around opening 43*a*. Base plate 43 also has a plurality of grooves 43*c* formed to be in fluid communication with holes 43*b*. Grooves 43*c* are each provided with an O-ring 60**.

Referring to FIGS. 9 and 10, control plate 34 has a notch portion 46 formed on a first end surface thereof and at least partially surrounding opening **34*a*. Control plate 34 also has a plurality of channels 33 preferably corresponding to a number of cylinders 170. Preferably, channels 33 have an arc-shaped axial cross section and are equally spaced about a periphery of control plate 34. As shown best in FIG. 10, a radial cross-section of channel 33 of notch portion 46 includes first stage portion 33*a* having depth D, which is formed to be linear and parallel to the first end surface of control plate 34. Channel 33 also has a second stage portion 33*b* formed to be linear, and which comprises a portion of the first end surface of control plate 34. Channel 33 also has inclined portion 33*c* formed to join first stage portion 33*a*** and second stage portion 33b and, therefore being inclined with respect to the first end surface of control plate 34. Control plate 34 further includes cavity 46a formed therein and opening to the surface of notch portion 46. Base plate 43 has a similar cavity 43d formed on a surface thereof and opening toward notch portion 46. Ring spring 45 has first end portion 45a extending in an axial direction and second end portion 45b extending in an opposite axial direction and is disposed within notched portion so that first end portion 45a and second end portion 45b are respectively inserted into cavity 46a of control plate 46 and cavity 43d of base plate 43.

Further, referring to FIG. 4, cylinder block 121 includes a plurality of recessed portions 50 formed near each of cylinders 170. Preferably, recessed portions 50 are formed radially inward of, and adjacent to, cylinders 170. Each recessed portion 50 includes a first cylindrical portion 50a opening to an end surface of cylinder block 121, a second cylindrical portion 50b extending from first cylindrical portion 50a toward crank chamber 122, and a semi-cylindrical portion 50c communicating cylinder 170 and first cylindrical portion 50a. Second cylindrical portion 50b preferably has a smaller diameter than first cylindrical portion 50a.

Referring further to FIG. 8, suction valve mechanism 30 also comprises a stopper 31 disposed between cylinder block 121 and suction chamber 23, and extending through a hole formed in valve plate 35. Stopper 31 includes end portion 31b, a cylindrical portion 31c, and a flange portion 31a located at an end of cylindrical portion 31c opposite end portion 31b. Flange portion 31a is capable of fittingly contact an edge of suction valve 26. In a rest state, stopper 31 is urged toward the direction of suction chamber 23 by a restoring force of a first coil spring 32, which is disposed at least partly within second cylindrical portion 50b of recessed portion 50. Preferably, first coil spring 32 extends completely to a bottom portion 50c of recessed portion 50. The bias of stopper 31 and the contact of flange portion 31a with suction valve 26 thus tends to close suction valve 26.

Referring again to FIG. 5, control plate 34 also has a pin portion 37 axially extending from a second end surface thereof. Rear end plate 13 is provided with piston mechanism 35 therein. Piston mechanism 35 includes a cylinder 39 arranged to be substantially perpendicular to the axis of drive shaft 126, a piston 38 disposed within cylinder 39, a rod 36 extending from piston 38 toward suction chamber 23 and engageable with pin portion 37. Piston 38 is preferably capable of reciprocating within cylinder 39. A first end of cylinder 39 is closed by a faucet 40. A second coil spring 41 is disposed between a second end of cylinder 39 and piston 38 so as to urge piston 38 toward faucet 40. Cylinder 39 is communicated with discharge chamber 24 through passage 42 formed therebetween in rear end plate 13.

In operation, drive shaft 126 is rotated by the engine of the vehicle through electromagnetic clutch 300. Cam rotor 140 rotates together with drive shaft 126, thereby rotating slant plate 150, which causes wobble plate 160 to nutate. The nutational motion of wobble plate 160 reciprocates pistons 171 in their respective cylinders 170. As pistons 171 are reciprocated, a refrigerant gas is introduced into suction chamber 23 through inlet port 23a. The gas then passes to cylinders 170 through suction valve mechanism 30 where it is compressed. The compressed refrigerant gas is discharged to discharge chamber 24 from each cylinder 170 through discharge conduits 27, and therefrom into the cooling circuit (not shown) through outlet port 24a.

The operation of suction valve mechanism 30 will now be described in greater detail. When stopper 31 is at the position as shown in FIG. 4, flange portion 31a is at an axially shallow position within recessed portion 50. In this state, suction valve 26 can only open to a minimum opening level. The pressure in cylinder 39 increases due to an increase of the pressure within discharge chamber 24. Thus, a difference is created between the pressure in cylinder 39 and the pressure in suction chamber 23. Accordingly, piston 38 moves toward suction chamber 23 against the restoring force of second coil spring 41. End portion 36a of position rod 36 protrudes from cylinder 39 and engages pin portion 37 to rotate control plate 34 in an amount equal to angle θ against the restoring force of ring spring 45. The rotational movement of control plate 34 is depicted by arrow A shown in FIG. 10. As channel 33 consequently moves with control plate 34, stopper 31 is pushed downward by inclined portion 33c, against the restoring force of first coil spring 32. Flange portion 31a thereby moves to an axially deep position within recessed portion 50. At this point, suction valve 26 can open to a maximum opening level. This is shown, for example, in FIG. 6.

Figure 6:
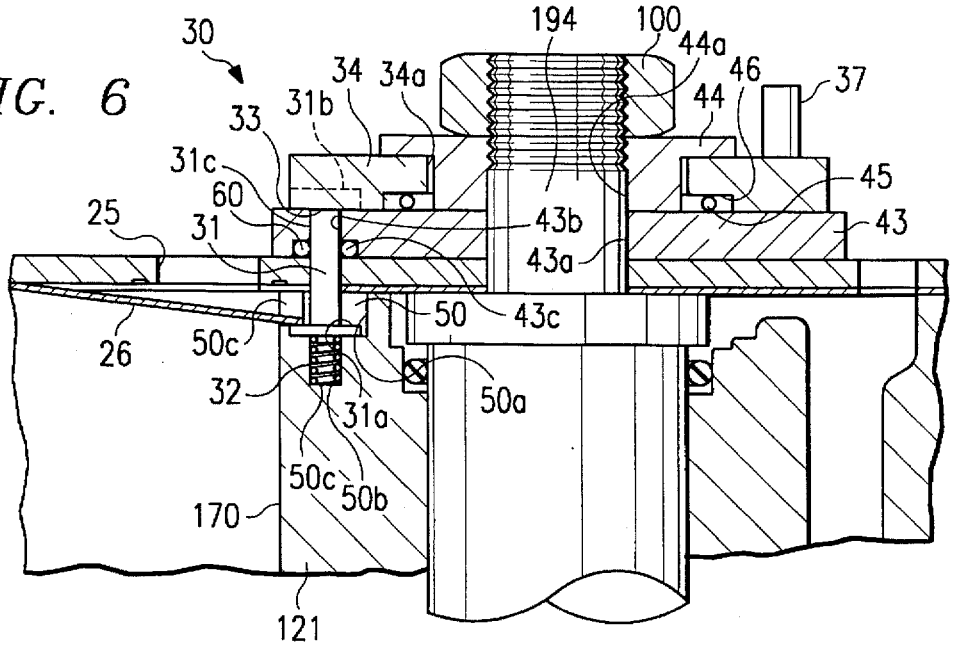
FIG. 6 is an enlarged sectional view of a suction valve assembly in accordance with a first embodiment of the present invention.
Figure 7:
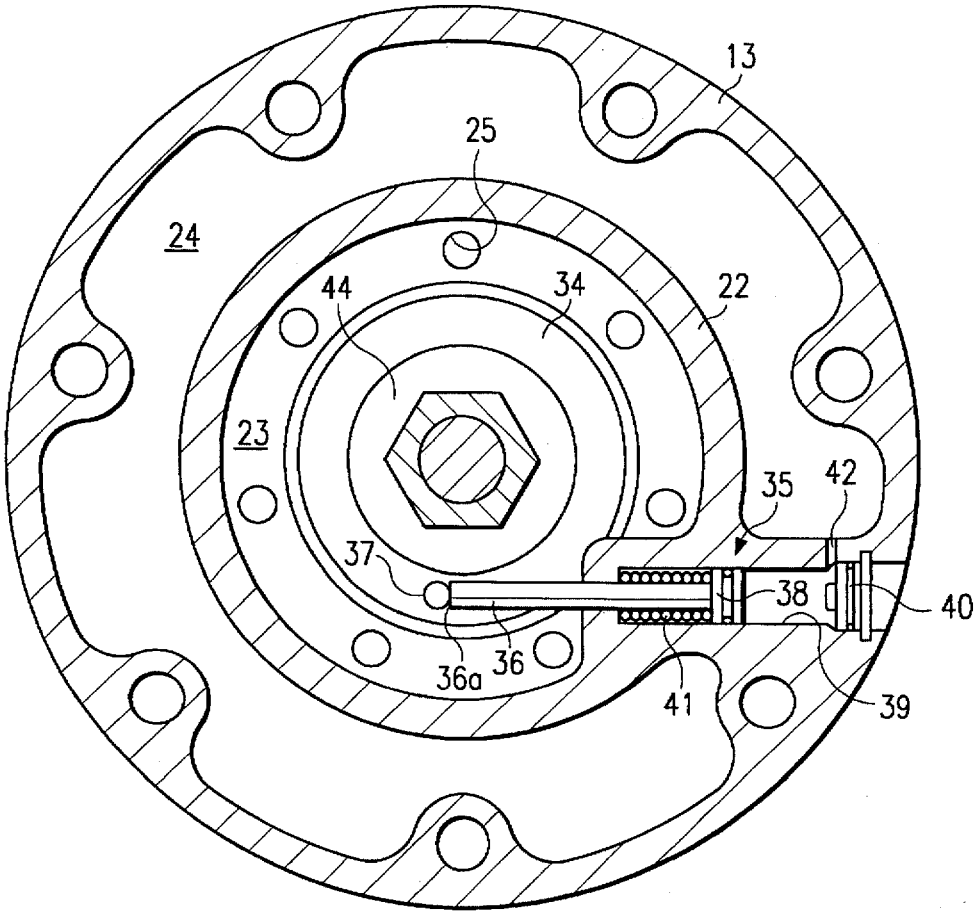
FIG. 7 is cross-sectional view of the compressor of FIG. 3. taken along line 5—5 showing the suction valve assembly of FIG. 6.

On the other hand, referring to FIGS. 6 and 7, when flange portion 31a is at an axially deep position, the pressure in discharge chamber 24 decreases. Piston 38 consequently moves toward faucet 40 since the restoring force of coil 41 can once again overcome the pressure in cylinder 39. Piston rod 36 releases pin portion 37 of control plate 34. The restoring force of ring spring 45 can then rotate control plate 34 in a direction opposite that described above. This direction is opposite the direction indicated by arrow A (FIG. 10). Stopper 31 thus returns to the axially shallow position where suction valve 26 can only open to the minimum opening level.

As described above in connection with FIG. 1, the pressure of discharge chamber 24 is relatively low at the time of starting the compressor. At this time, the position of flange portion 31a stopper 31 is at the shallow level. In this state, a relatively small amount of refrigerant gas is introduced into cylinders 170 through suction conduit 25 since suction valve 26 is at a minimum opening level. Therefore, the compressor need not conduct excessive compression work during starting and compressed gas is gradually discharged to discharge chamber 24 from cylinder 170. As a result, torque shock of the compressor during starting can be reduced.

When the pressure in discharge chamber 24 is low, as in a low-load situation, flange portion 31a is at the shallow position. Suction valve 26 is restricted by flange portion 31a, such that movement of an end portion of suction valve 26 is limited. This reduces ripple noise in suction valve 26. However, in this situation, the pressure loss of refrigerant gas through suction conduit 25 increases, and the volumetric compressor efficiency decreases. Generally, volumetric efficiency is defined by a ratio of theoretical piston displacement volume to practical displacement. Thereafter, as the pressure in discharge chamber 24 gradually increases, flange portion 31a moves to the deep position. The pressure loss of refrigerant gas through suction conduit 25 decreases since the opening level of suction valve 26 is at a maximum level. Thus, the volumetric efficiency of compressor 11 increases. Therefore, compressor 11 can obtain a high volumetric efficiency during high load operation. This advantage allows for a more compact compressor due to higher discharge ability of compressor 11 as compared to the discharge ability of prior art compressors of the same size. This higher discharge ability is obtained while simultaneously reducing vibrational valve noise and starting torque shock.

Figure 13:
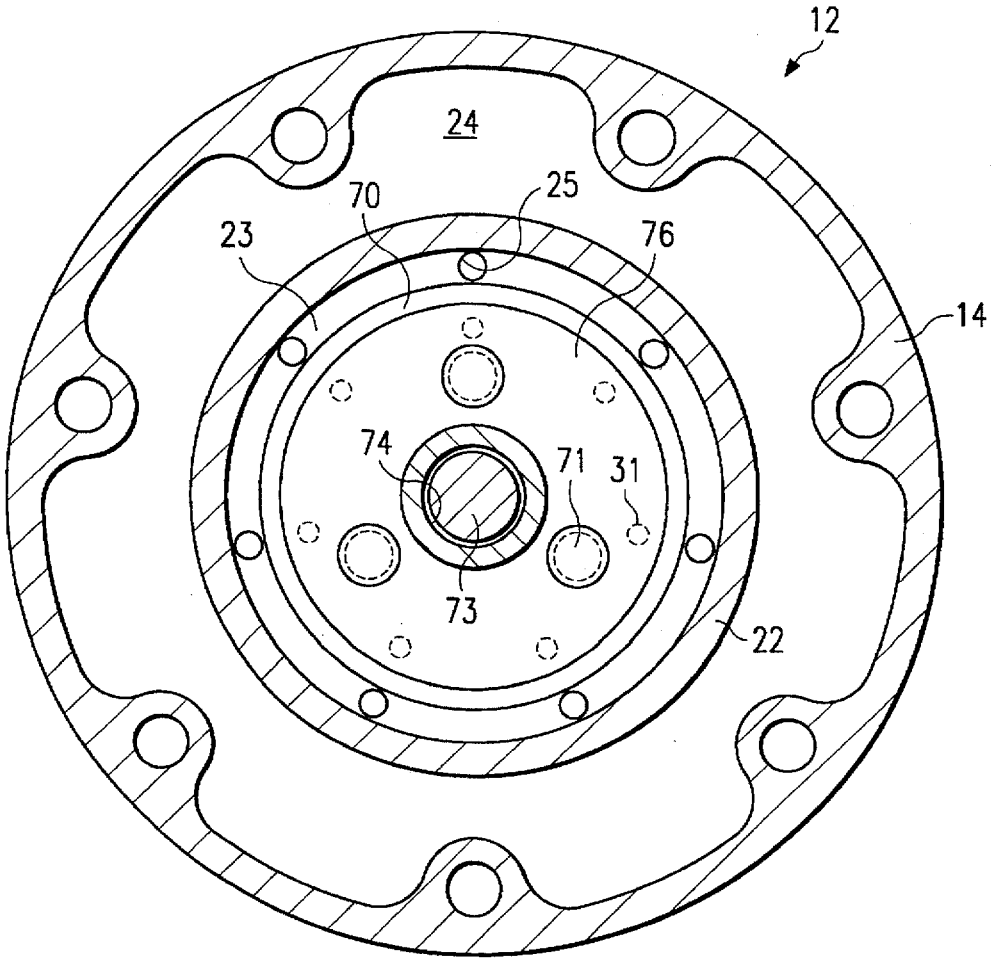
FIG. 13 is a longitudinal cross-sectional view of a compressor in accordance with a second embodiment of the present invention and showing the section valve assembly of FIG. 12.
Figure 11:
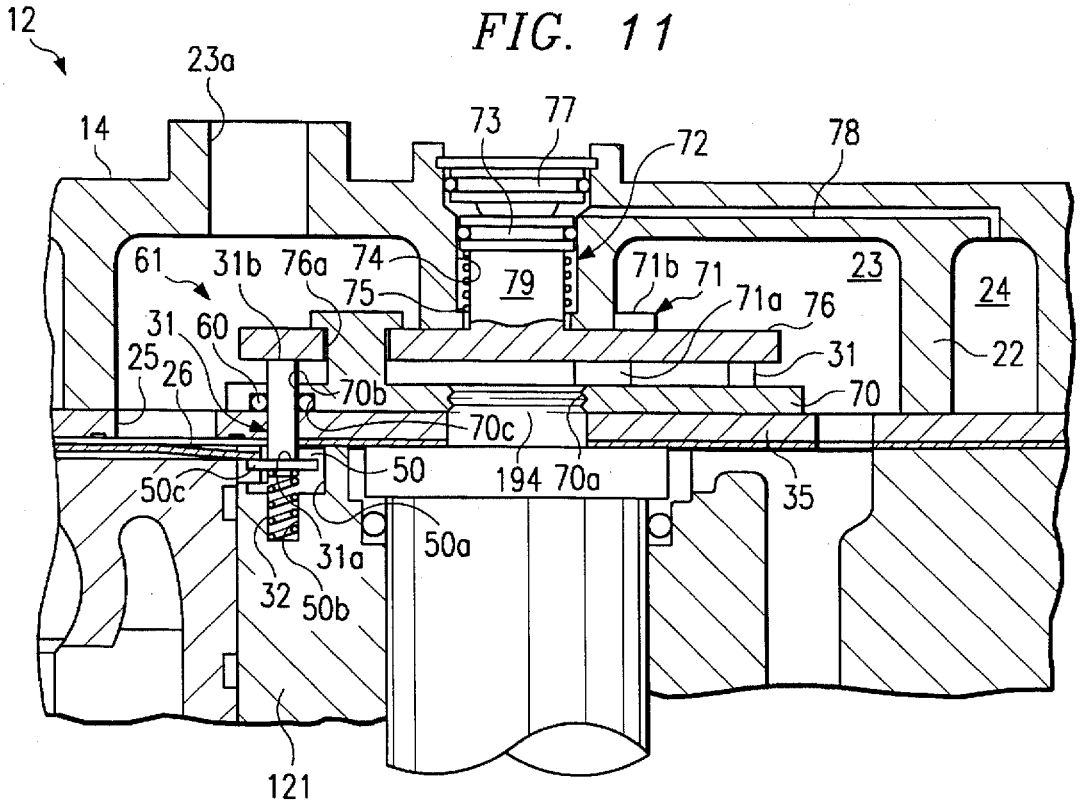
FIG. 11 is an enlarged sectional view of a suction valve assembly in accordance with a second embodiment of the present invention.
Figure 12:
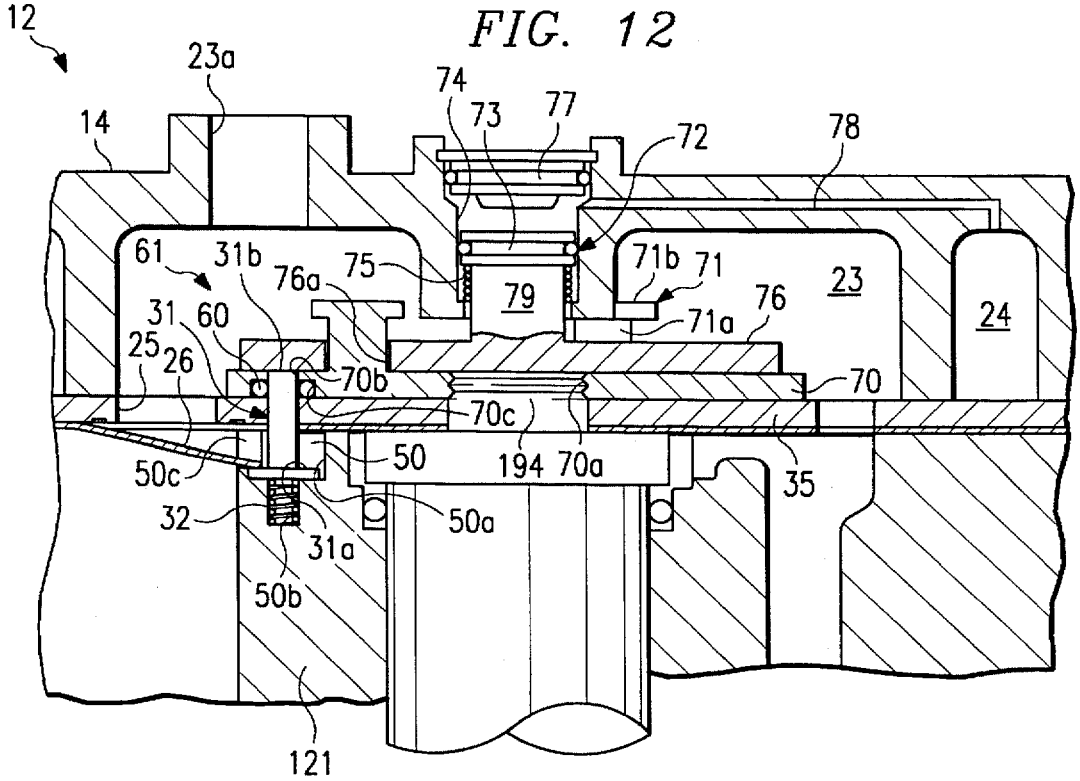
FIG. 12 is an enlarged sectional view of a suction valve assembly in accordance with a second embodiment of the present invention.

FIGS. 11, 12 and 13 illustrate a second embodiment of the present invention. Compressor 12 generally functions similarly to compressor 11 depicted, for example, in FIG. 3. Certain aspects described below, however, are different. Suction valve mechanism 61 comprises base plate 70 in contact with a first side surface of valve plate 35, and piston mechanism 72 axially disposed in a central portion of rear end plate 14. Base plate 70 includes threading hole 70*a* formed at a central portion thereof. Cylindrical member 194 is threaded into hole 70*a*. Base plate 70 also comprises a plurality of holes 70*b*, preferably corresponding to a number of cylinders 170, and preferably formed at equal intervals around threading hole 70*a*. Base plate 70 further comprises a plurality of grooves 70*c* formed to be in fluid communication with holes 70*b*. Grooves 70*c* are provided with O-rings 60.

Further, suction valve mechanism 61 includes a plurality of pin members 71, each having a cylindrical portion 71*a* and flange portion 71*b* formed at an end thereof. Piston mechanism 72 includes cylinder 74 formed in rear end plate 14 and being substantially coaxial with drive shaft 126. Piston mechanism 72 also includes piston 73 disposed within cylinder 74 and connected to a first end of a piston rod 79, and control plate 76 connected to a second end of piston rod 79, which is toward cylinder block 121. A first end of cylinder 74 is closed by faucet 77. First coil spring 75 is disposed between a second end of cylinder 74 and piston 73. Cylinder 74 is in fluid communication with annular discharge chamber 24 through passage 78 formed therebetween in rear end plate 14. Control plate 76 includes a plurality of openings 76*a* formed therein, which are preferably located at equal intervals around the center of control plate 76. Further, the plurality of pin members 71 extend respectively through openings 76*a* of control plate 76 and are connected to base plate 70 so that control plate 76 can move axially, while limited in movement by flange portions 71*b* and base plate 70.

In this arrangement, when stopper 31 is at the position shown in FIG. 11, flange portion 31*a* is at a shallow position within recessed portion 50, and suction valve 26 can only open to a minimum opening level. In this situation, the pressure in cylinder 74 increases as the pressure within discharge chamber 24 increases. Thus, a difference in pressure is created between cylinder 74 and suction chamber 23. This causes piston 73 to move toward base plate 70 against the restoring force of first coil spring 75. Control plate 76 engages end portion 31*b* of stopper 31 and moves flange 31*a* toward crank chamber 122 against the restoring force of second coil spring 32. When control plate 76 reaches base plate 70, stopper 31 has moved a maximum amount and flange portion 31*a* is at the deep position within recessed portion 50, as shown in FIG. 12. At this point, suction valve 26 can open to a maximum opening level.

When the pressure in discharge chamber 24 decreases, piston 73 moves toward faucet 77 since the restoring force of first coil spring 75 becomes sufficient to overcome the pressure in cylinder 74. Control plate 76 consequently moves toward faucet 77. Stopper 31 moves toward rear end plate 14 due to the restoring force of second coil spring 32. Flange portion 31*a* thus returns to the shallow position and, once again, suction valve 26 can only open to a minimum opening level. In such a structure according to this embodiment, substantially the same advantages as those described in connection with the above-described embodiments can be obtained.

Although the present invention has been described in connection with the preferred embodiments, the invention is not limited thereto. It will be easily understood by those of ordinary skill in the art that variations and modifications can be easily made within the scope of this invention as defined by the appended claims.

I claim:

1. A compressor comprising:

a housing;

a valve plate at least partially disposed in said housing and dividing said housing into at least a first chamber and a second chamber, the second chamber including a discharge chamber and a suction chamber;

linking means for linking the first chamber to the second chamber, the linking means including a plurality of discharge conduits communicating the first chamber with the discharge chamber, and a plurality of suction conduits communicating the first chamber with the suction chamber;

a plurality of discharge valve members, each of which is responsive to a difference in pressure between the first chamber and the discharge chamber to bend to open and close the end opening of a corresponding discharge conduit;

a plurality of suction valve members each of which is responsive to a difference in pressure between the first chamber and the suction chamber to bend to open and close the end opening of a corresponding suction conduit; and a suction valve control mechanism comprising a regulator for regulating the opening of the suction conduits in response to a change in a discharge chamber pressure.

2. The compressor of claim 1, wherein the regulator causes the suction valve members to open toward a maximum opening position in response to an increase in discharge chamber pressure, and toward a minimum opening position in response to a decrease in discharge chamber pressure.

3. A compressor comprising:

a housing;

a valve plate at least partially disposed in said housing and dividing said housing into at least a first chamber and a second chamber, the second chamber including a discharge chamber and a suction chamber;

linking means for linking the first chamber to the second chamber, the linking means including a plurality of discharge conduits communicating the first chamber with the discharge chamber, and a plurality of suction conduits communicating the first chamber with the suction chamber;

a plurality of discharge valve members, each of which is responsive to a difference in pressure between the first chamber and the discharge chamber to bend to open and close the end opening of a corresponding discharge conduit;

a plurality of suction valve members each of which is responsive to a difference in pressure between the first chamber and the suction chamber to bend to open and close the end opening of a corresponding suction conduit; and a suction valve control mechanism comprising a regulator for regulating the opening of the suction conduits in response to a change in a discharge chamber pressure, wherein the regulator causes the suction valve members to open toward a maximum opening position in response to an increase in discharge chamber pressure, and toward a minimum opening position in response to a decrease in discharge chamber pressure, and wherein the regulator comprises a stopper having a first end which limits movement of the suction valve members toward the maximum opening position, a control member engaging a second end of the stopper to move the stopper member toward the maximum opening position and limit the movement of the stopper toward the minimum opening position, and a piston mechanism comprising a piston rod for engaging the control member to move the control member, the piston mechanism being responsive to a change in the discharge chamber pressure.

4. The compressor of claim 3, wherein the control member is a plate member rotatably movable about a longitudinal axis of the compressor and having a channel formed in a surface thereof for slidably contacting with the second end of the stopper to move the stopper.

5. The refrigerant compressor of claim 3, wherein the control member is a plate member for reciprocating about a longitudinal axis of the compressor between a first position corresponding to the minimum opening position of the suction valve member and a second position corresponding to the maximum opening position of the suction valve member.

6. The refrigerant compressor of claim 3, further comprising a spring engageable with the stopper, wherein the stopper is moved toward the minimum opening position by a restoring force of the spring.

7. The refrigerant compressor of claim 4, wherein the channel has an arc-shaped axial cross-section and wherein a direction of movement of the channel is substantially perpendicular to a direction of movement of the stopper.

8. The compressor of claim 3, wherein the piston mechanism is responsive to an increase in discharge chamber pressure to move the control member in a first direction to move the stopper toward the maximum opening position.

9. The compressor of claim 8 further comprising a first spring to urge the stopper toward a minimum opening position in response to a decrease in discharge chamber pressure.

10. The compressor of claim 9 further comprising a second spring to urge the control member in a second direction opposite the first direction to allow movement of the stopper toward the minimum opening position.

11. The compressor of claim 4 wherein the channel has an inclined portion extending from a first level at the surface of the plate member to a second level axially spaced from the first level, wherein movement of the plate member in a first direction causes the first level of the inclined portion to approach the second end of the stopper to move the stopper toward the maximum opening position, and wherein movement of the plate member in a second direction opposite the first direction causes the second level of the inclined portion to approach the second end of the stopper to permit the stopper to move toward the minimum opening position.

12. A suction valve assembly for use in a compressor having a suction chamber and a discharge chamber on one side of a valve plate and a cylinder chamber on the other side of the valve plate, the assembly comprising:

a stopper disposed within a passage communicating the suction chamber and the cylinder chamber, the passage including a conduit extending through the valve plate, the stopper being movable between a first position and a second position;

a control mechanism for controlling movement of the stopper; and a valve member positioned at an end of the conduit opening toward the cylinder chamber, the valve member in contact with the stopper, wherein the control mechanism is responsive to a change in a discharge chamber pressure to cause the stopper to move between the first and second positions, wherein movement of the stopper toward the first position permits movement of the valve member toward a minimum opening position at which the conduit is opened a minimum amount, and wherein movement of the stopper toward the second position causes movement of the valve member toward a maximum opening position at which the conduit is opened a maximum amount.

13. A suction valve assembly for use in a compressor having a suction chamber and a discharge chamber on one side of a valve plate and a cylinder chamber on the other side of the valve plate, the assembly comprising:

a stopper disposed within a passage communicating the suction chamber and the cylinder chamber, the passage including a conduit extending through the valve plate, the stopper being movable between a first position and a second position;

a valve member positioned at an end of the conduit opening toward the cylinder chamber, the valve member in contact with a first end of the stopper, the first end of the stopper limiting movement of the valve member toward a maximum opening position;

a control mechanism for controlling movement of the stopper, the control member engaging a second end of the stopper to move the stopper toward the second position and limit movement of the stopper toward the first position; and a piston mechanism comprising a piston rod for moving the control member, the piston mechanism being responsive to a change in a discharge chamber pressure to cause the control member to cause the cause the stopper to move between the first and second positions, wherein movement of the stopper toward the first position permits movement of the valve member toward a minimum opening position at which the conduit is opened a minimum amount, wherein movement of the stopper toward the second position causes movement of the valve member toward the maximum opening position at which the conduit is opened a maximum amount, and wherein the stopper is biased toward the first position by a spring.

14. The suction valve assembly of claim 12 wherein the control mechanism causes the stopper to move toward the second position in response to an increase in discharge chamber pressure.

15. The suction valve assembly of claim 12 further comprising a pressure differential responsive device disposed within a compartment, the compartment being in communication with the discharge chamber, the pressure differential responsive device being coupled to the stopper to move the stopper toward the second position in response to an increase in discharge chamber pressure.

16. The suction valve assembly of claim 15 further comprising a control member for coupling the pressure differential responsive device to the stopper, the pressure differential responsive device engageable with the control member to move the control member in a first direction in response to a decrease in discharge chamber pressure and in a second direction in response to an increase in discharge chamber pressure, wherein movement of the control member in the first direction causes movement of the stopper toward the first position and wherein movement of the control member in the second direction causes movement of the stopper toward the second position.

17. The suction valve assembly of claim 16 wherein when the control member moves between the first direction and the second direction, the control member reciprocates within a plane and about an axis which extends perpendicular to the plane.

18. The compressor of claim 3, wherein the control member is a plate member for reciprocating along a longitudinal axis of the compressor between a first position corresponding to the minimum opening position of the suction valve member and a second position corresponding to the maximum opening position of the suction valve member.

19. The suction valve assembly of claim 16 wherein when the control member moves between the first direction and the second direction, the control member reciprocates along a longitudinal axis of the compressor.

* * * * *